US010111513B2

(12) United States Patent
Rhoades et al.

(10) Patent No.: US 10,111,513 B2
(45) **Date of Patent: *Oct. 30, 2018**

(54) EYELINER GUIDE AND METHOD

(71) Applicants: Theresa Virginia Rhoades, Columbia, SC (US); Harold Freddie Johnson, Columbia, SC (US)

(72) Inventors: Theresa Virginia Rhoades, Columbia, SC (US); Harold Freddie Johnson, Columbia, SC (US)

( * ) Notice: Subject to any disclaimer, the term of this patent is extended or adjusted under 35 U.S.C. 154(b) by 96 days.

This patent is subject to a terminal disclaimer.

(21) Appl. No.: 14/830,855

(22) Filed: Aug. 20, 2015

(65) Prior Publication Data

US 2017/0049216 A1 Feb. 23, 2017

(51) Int. Cl.
*A45D 40/30* (2006.01)
*A45D 40/18* (2006.01)

(52) U.S. Cl.
CPC ..... *A45D 40/30* (2013.01); *A45D 40/18* (2013.01); *A45D 2200/1072* (2013.01)

(58) Field of Classification Search
CPC ..... A45C 11/008; A45C 5/005; A45D 40/30; A45D 44/12; A45D 40/26; A45D 2200/1018; B65D 25/28
USPC ..... 206/581; 220/756; 81/490; 132/216
See application file for complete search history.

(56) References Cited

U.S. PATENT DOCUMENTS

| | | | | |
|---|---|---|---|---|
| 1,907,476 | A * | 5/1933 | Ballard | A45D 40/30 132/216 |
| 3,343,552 | A | 9/1967 | Steffen | |
| 3,884,232 | A * | 5/1975 | Braun | A61F 9/0008 132/333 |
| 4,033,364 | A * | 7/1977 | Inzana | A45D 40/30 132/216 |
| 6,199,560 | B1 * | 3/2001 | North | A45D 44/12 132/319 |
| 6,508,255 | B1 | 1/2003 | Glover et al. | |
| 6,640,814 | B1 * | 11/2003 | Burke | A45D 40/30 132/319 |
| 7,478,958 | B2 * | 1/2009 | Ramet | A45D 40/26 401/123 |
| 8,141,564 | B2 * | 3/2012 | Cassese | A45D 2/48 132/319 |
| 8,939,159 | B2 | 1/2015 | Yeo et al. | |
| D776,343 | S * | 1/2017 | Rhoades | D28/7 |
| 2004/0255971 | A1 * | 12/2004 | Houghton | A45D 40/30 132/319 |
| 2006/0225761 | A1 * | 10/2006 | Secosky | A45D 40/18 132/218 |

(Continued)

*Primary Examiner* — Tatiana Nobrega
*Assistant Examiner* — Jennifer Gill
(74) *Attorney, Agent, or Firm* — Southeast IP Group, LLC.; Thomas L. Moses; Randolph J. Tucker

(57) ABSTRACT

An eyeliner guide and method of applying eyeliner that allows a user to steadily and neatly apply eyeliner is disclosed. The eyeliner guide includes a handle portion, a neck member and eyelid contact member. The eyelid contact member may be removably attached to the handle, and may be angularly adjustable in clockwise or counterclockwise fashion. In use, the eyelid contact member is placed against a user's eyelid, and eyeliner may be applied to a user's eyelid by tracing along the curved head of the eyelid contact member to form a straight, neat makeup line.

10 Claims, 4 Drawing Sheets

(56) References Cited

U.S. PATENT DOCUMENTS

| | | | | |
|---|---|---|---|---|
| 2009/0311032 | A1* | 12/2009 | Kurek | A45D 34/06 401/195 |
| 2011/0076085 | A1* | 3/2011 | Jollet | A45D 2/48 401/1 |
| 2013/0152962 | A1* | 6/2013 | Pires | A45D 33/006 132/313 |
| 2014/0109928 | A1* | 4/2014 | Simard | A46B 5/0075 132/200 |
| 2016/0286936 | A1* | 10/2016 | Ashburn | A45D 40/30 |

* cited by examiner

EYELINER GUIDE AND METHOD

BACKGROUND OF THE INVENTION

Proper application of eyeliner around the eye can be difficult. A steady hand and coordination are required to apply eyeliner because of the proximity to the eye and the desire to neatly and closely parallel the eyelashes. Misapplications can result in uneven or crooked makeup lines, accumulations or clumps of eyeliner on undesired portions of the eyelid or even the eye. Eyeliner contact with the eye can irritate the eye.

Devices have been developed in attempt to prevent eye injury and make-up accumulation on the delicate eyelid skin surrounding the eye. However, the vast majority of these do not accommodate different eye shapes or sizes by allowing a user to interchange portions of the device and do not accommodate multiple methods and styles of applying eyeliner.

Examples of such devices include the following: U.S. Pat. No. 3,343,442 discloses an eye lining device having a handle and a curved applicator to which lining material is applied. The curvature of the applicator complements the curvature of an eye lid. After lining material is applied to the applicator, it is brought into contact with the lashes and slid inwardly therealong until contact with the eye lid is made.

U.S. Pat. No. 4,033,364 discloses a shield for use in applying mascara to the eyelashes which prevents the smudging of previously applied eye shadow and/or eye liner. The shield comprises an elongate handle portion (which may optionally include a mascara container) and an eyelid covering portion having a shape and curvature generally conforming to the shape and curvature of an upper human eyelid and which when placed over an upper human eyelid will cover same and thereby shield any eye shadow previously applied thereto while leaving the upper eyelashes exposed for the application of mascara without any risk of smudging the thusly shielded eye shadow with said mascara.

U.S. Pat. No. 6,508,255 discloses an eyeliner applicator and method of using the applicator. The applicator comprises two arms, each arm having a proximal and a distal end. The proximal ends of the arms are supported such that the distal ends of the arms are maintained in a spaced apart relationship. An applicator surface extends from the distal end of one arm to the distal end of the other arm. The proximal ends of the arms may be connected directly to each other or to an intermediary member. Optionally, a handle may depend from the arms or the intermediary member. Optionally, the applicator surface is treated in any of various ways to enhance its functioning. Optionally, a stabilizing member is provided for bracing the applicator against the body during application. Optionally, a supply of applicator surface material is provided to allow the applicator surface to be replaced between applications.

U.S. Patent Application Publication No. 2004/0255971 A1 discloses an eye makeup application device that includes a handle and ends that are shaped to conform to the human upper and lower eyelids. The eye makeup application device is adapted to enable a farsighted user to insert the ends behind eyeglasses, obtain a desired position, and then apply the eye makeup accurately once the eyeglasses are removed. In the preferred form of the device, removable flexible pads are attached to the end and are able to more precisely conform to the shape of a specific individuals eyelid. Additionally, the ability to remove the flexible pads allows for periodic cleaning or replacement.

U.S. Pat. No. 7,478,958 discloses an applicator device includes a grasping element, two arms mounted on the grasping element and an applicator between the two arms. The applicator can apply a product in the form of a line onto a surface. The device can additionally include a reservoir containing the product such that the grasping element incorporates a mechanism to hold the reservoir in a position preventing the applicator from being charged when the latter is applied against the application surface.

U.S. Pat. No. 8,141,564 discloses a lightweight, portable article for precise application of makeup that is placed upon a user's eyelid skin, preferably the bottom eyelid skin, adjacent to the eyelashes. With this placement, a user can readily apply mascara and/or eyeliner without contacting the delicate eyelid skin. The article has a handle portion and an arcuate top portion. The arcuate top portion includes an applicator rim with rounded lateral edges and an arced central section, both of which are covered with the rubber guard. The rubber guard contiguously traverses the entire surface area of the applicator rim, resulting in a device yielding a high degree of safety. The article is formed of a smooth polymeric or metal material. It is compact, easily cleaned and enables application of mascara in a safe, hygienic manner.

U.S. Pat. No. 8,939,159 discloses an apparatus for assisting in the application of eyeliner. A handle connects to a shaped member, such as a metal rod, which comprises a guide portion for abutting against a user's eyelid. Users may apply eyeliner by drawing an eyeliner applicator along a side of the guide portion. The guide portion may optionally end in a wing, allowing users to draw eyeliner "wings". A nose bridge may be situated between the guide portion and the handle, allowing the apparatus to be positioned across a user's nose. The handle may comprise a smudger with which a user may smudge eyeliner after it has been applied.

Each of the references mentioned above are hereby incorporated herein, in their entirety, by reference.

However, these earlier efforts suffer from one or more of the following disadvantages: The devices are complicated, do not allow for an interchangeable guard eyelid member, do not allow for multiple types of applications or styles of eyeliner application, do not accommodate different shape or size eyes, and do not provide alternative and more comfortable handle holding angles.

For the foregoing reasons, there is a need for an eyeliner guide and method that is simple, allows for an interchangeable guard eyelid contact member to correspond to eyes of different sizes and shapes, allows a user to utilize multiple types and styles of eyeliner application, and accommodates different holding angles to maximize comfort in use.

BRIEF SUMMARY OF THE INVENTION

In accordance with one aspect of the invention, the present apparatus relates to an eyeliner guide that is simple to operate, has interchangeable eyelid contact members and handles, and allows the handle to extend at different angles.

The eyeliner guide is useful in facilitating the application of eyeliner on the eyelid adjacent the eyelashes to accentuate the eye. The eyeliner guide allows for use of multiple types of eyeliner applicators and different styles of eyeliner application. The eyeliner guide further aids in preventing the misapplication of eyeliner to the an undesired portion of the eyelid or the eye by providing a rim of the apparatus which an eyeliner applicator may abut and use to guide eyeliner application and by covering the remaining portion of the eyelid. This method of application aids in the steady neat application of eyeliner to the desired portion of the eyelid.

According to one aspect, the guide includes a handle portion attached to a neck member, which is connected to an eyelid contact member. The eyelid contact member may be removably attached, which allows for interchangeable use of alternatively shaped and sized eyelid contact members. The different sized and shaped eyelid contact members, which may be matched more specifically to correspond to the contours of a user's eye, allow for use of the guide on different size and shape eyes, with different eyeliner applicators, and with different styles of eyeliner application. Alternatively, a single eyelid contact member may be constructed to be angularly adjustable in a clockwise or counterclockwise fashion for the alteration of the angle at which the handle portion extends from the eyelid contact member. Different angles maximize the comfort and ease of use of the user who holds the unit up against the eyelid. Additionally, the eyelid contact member may have a cushion portion to provide a more comfortable contact between the eyelid and the guide. The cushion portion may include cushion material along an entire or part of an area of contact between the eyelid and eyelid contact member.

According to another aspect, the handle portion of the guide may be one or multiple sections, any desired shape, and any desired size. The handle portion may also be hollow to reduce the weight or amount of material utilized in the construction of the device. Additionally, the hollow inside of a handle portion may be accessible to allow for the storage of various items, which may include alternative eyelid contact members. Further, the handle portion may be contoured or made of or with materials to aid a user in securely gripping the guide. Alternatively, a separate grip member may be attached to the handle portion and may be contoured, made of specific materials, or both to aid a user in securely gripping the guide.

According to an additional aspect, the guide may be constructed of or with any desired material to provide any desired characteristics. For example, the guide may be made of a rigid plastic covered with silicone to provide a solid durable guide that may still provide for comfortable contact with the delicate skin of the eyelid and the ability to be easily cleaned. Additionally, the handle portion and eyelid contact member may be constructed of or with materials to provide aesthetically desirable features, such as color and texture. For example, a user may aesthetically desire the handle portion of the guide be made of wood and the eyelid contact member made of colored plastic with a clear or colored cushion portion.

According to yet another aspect, the guide may be utilized by a user applying the eyelid contact member to the eyelid and applying light pressure through the handle portion while utilizing an eyeliner applicator to apply eyeliner around the rim of the eyelid contact portion on an uncovered and desired portion of the eyelid. The method may be utilized for top and bottom eyelids on each eye. Further, a user may select from different eyelid contact portions to accommodate different eyelids and eyes, different eyeliner applicators, or different styles of eyeliner application.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1A:
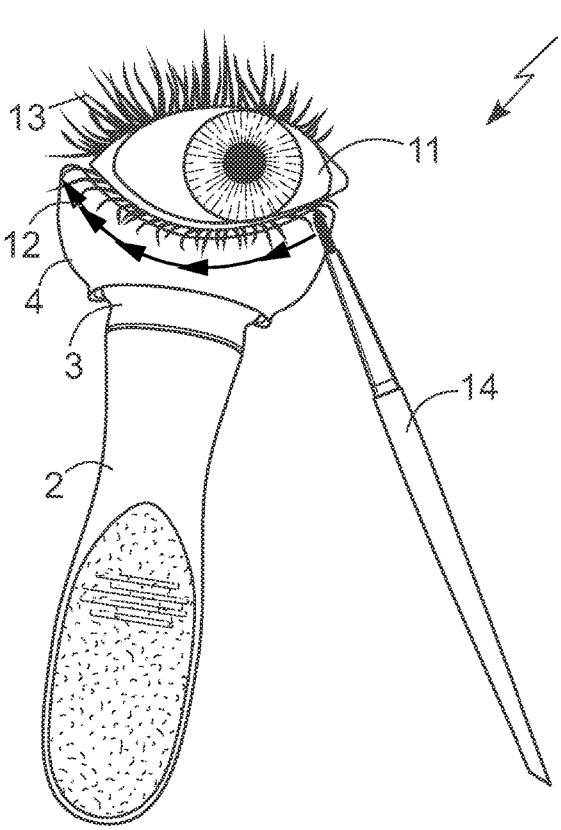
FIG. 1A is a front view of one embodiment of the eyeliner guide and eyeliner applicator positioned adjacent a user's lower eyelid prior to use and arrows showing the direction the eyeliner applicator may move during use.

The present invention is drawn to an eyeliner applicator guide 1 that assists a user with the application of eyeliner 15 to a user's eyelid 12 adjacent the eyelashes 13 to accentuate a user's eyes 11. In one embodiment shown in FIGS. 3A and 3B, the guide 1 includes a handle portion 2, a neck member 3, and an eyelid contact member 4. The eyelid contact member 4 includes a curved head 5, which corresponds to the shape and contour of a user's eyelid 12, as in FIGS. 1A and 1B, and is connected to a neck member 3 that is further connected to the handle portion 2. The neck member 3 is preferably disposed in a generally perpendicular angle with respect to the eyelid contact member 4, as shown in FIGS. 1A, 1B, 3A, 3B, 6A and 6B. The neck member 3 may be generally straight, or may include a forward curvature.

Figure 5A:
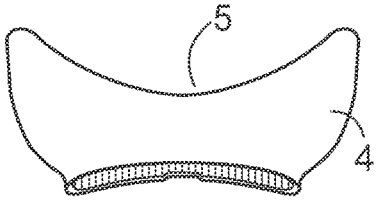
FIG. 5A is a front view of one embodiment of an eyelid contact member with a curved head of a first curvature.
Figure 5B:
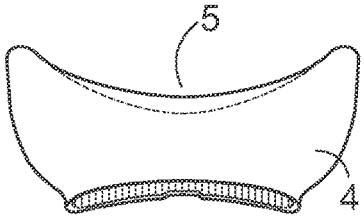
FIG. 5B is a front view of one embodiment of an eyelid contact member with a curved head with less curvature than the first curvature of curved head in FIG. 6A, represented by the dashed line.

A series of interchangeable eyelid contact members 4 of various shapes and sizes, as shown in FIGS. 5A and 5B, may be removably attached to neck member 3, as shown in FIG.

4A, so that a user may select an eyelid contact member 4 that most closely fits the contours of that specific user's eyelid 12.

Figure 4A:
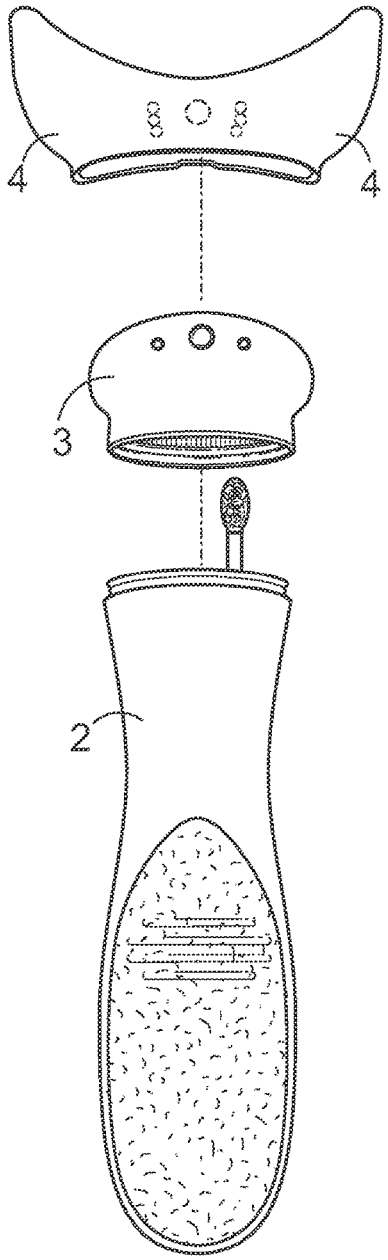
FIG. 4A is an exploded view of one embodiment of the eyeliner guide showing the eyelid contact member, neck member, and handle all separated from one another wherein the handle is hollow for storage and the neck member has adjustable snap-fit means that correspond to the snap-fit means on the eyelid contact member.
Figure 4B:
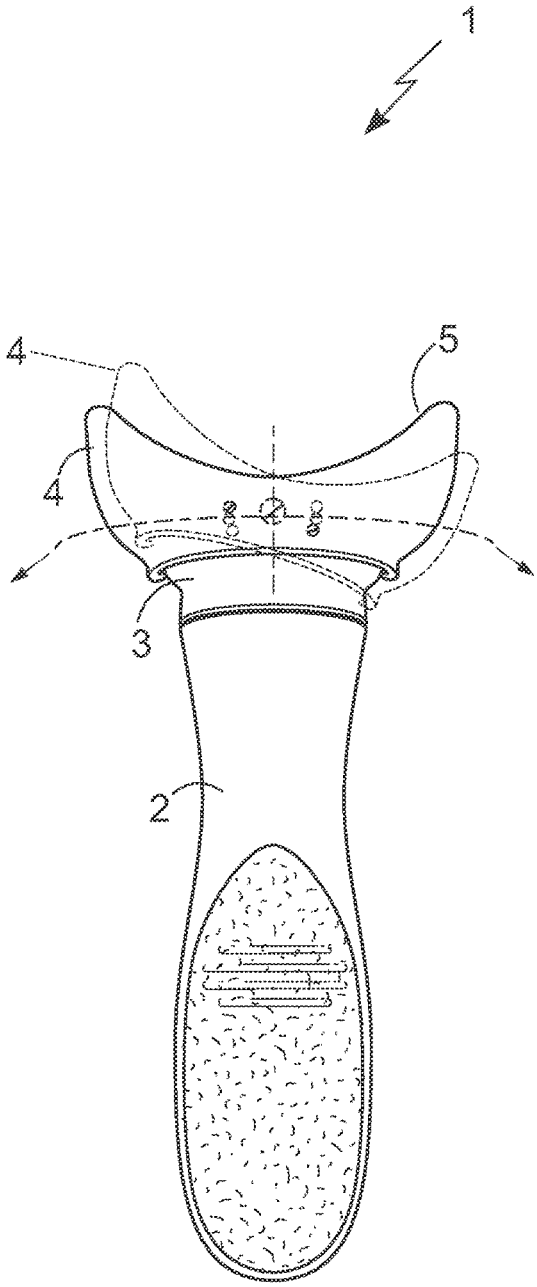
FIG. 4B is a front view of one embodiment of the eyeliner guide showing the handle, member, and eyelid contact member attached wherein the eyelid contact member may be adjusted from a first position to a second position represented by broken lines.

Further, in one embodiment shown in FIGS. 4A and 4B, the eyelid contact member 4 may be angularly adjustable with respect to the neck member 3 via a series of mating détentes (protrusions) and recesses on the neck member 3 and the eyelid contact member 4, so that a user may rotate the eyelid contact member 4 either clockwise or counterclockwise, as desired. When a user is applying eyeliner 15 on a first eyelid 12, the angle of the eyelid contact 20 member 4 may be adjusted to a first position for ease of use, and then when the user applying eyeliner 15 to a second eyelid 12 (and potentially using the opposite hand), the angle of the eyelid contact member 4 may be adjusted to a second position shown in FIG. 4B. Although, mating protrusions and recesses are discussed here, there are many means for providing such angular adjustability, and one skilled in the art will recognize that any suitable means for providing such angular adjustment may be employed.

The eyelid contact member 4 may be constructed with plastic, metal, silicone, or other desired materials. The eyelid contact member 4 may include a cushion portion 6 attached along the curved outer portion thereof, comprising a softer material to offer more comfort during contact with the eyelid 12. This cushion portion 6 may totally or partially encompass the curved area of the eyelid contact member 4 that is in contact with the eyelid 12. In one embodiment, the cushion portion 6 may be a strip of soft material just along the curved head 5 of the eyelid contact member 4. In a preferred embodiment, the cushion portion 6 may be made from a silicone. However, it is also anticipated that alternative materials may be used as desired in construction of the cushion portion 6.

Figure 6A:
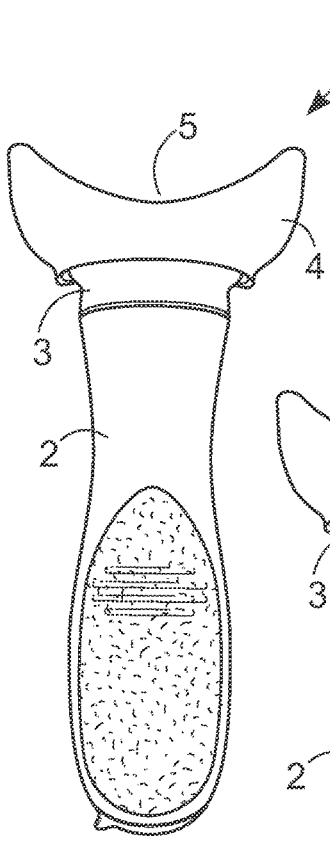
FIG. 6A is a front view of one embodiment of the eyeliner guide with a closed cap that allows access to a hollow interior space inside the handle.
Figure 6B:
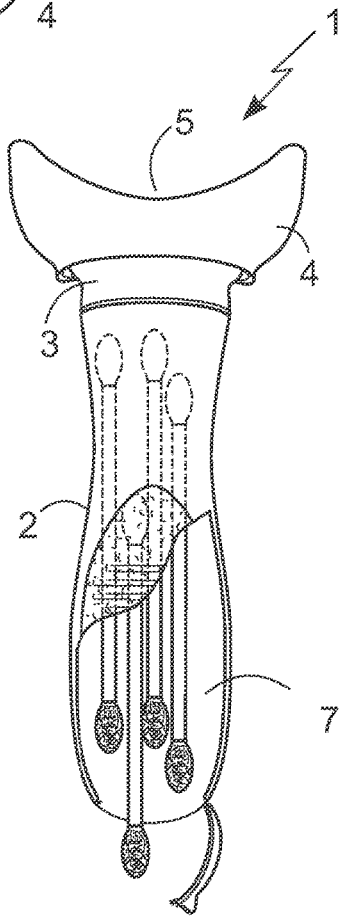
FIG. 6B is a partially torn away front view of the eyeliner guide of FIG. 5A showing an open cap providing access to the hollow space inside the handle and cotton swabs inserted therein for storage.

In alternate embodiments, the handle portion 2 may be removably attached or permanently affixed to the neck member 3. The handle portion 2 may allow attachment of two eyelid contact members 4, one at each distal end of the handle portion 2. The handle portion 2 may consist of one section or multiple sections. The handle portion 2 may be different shapes and sizes as a user desires. The handle portion 2 may be contoured to aid a user in securely gripping the guide 1. Further, the handle portion 2 may have a grip member that is composed of a material or contoured to aid a user in securely gripping the guide 1. Likewise, the handle portion 2 itself may be composed of a material to aid a user in securely gripping the guide 1. The handle portion 2 may additionally be hollow to reduce the weight of the guide 1 or to allow access to the hollow interior 7 for storage purposes as shown in FIG. 6B. In one embodiment the handle portion 2 may have an accessible hollow interior 7 and be sized and shaped to accommodate a spare eyelid contact member 4, cotton swabs, or other small items.

The guide 1 may be made of or with a variety of materials, including but not limited to polymers and metals, in order to provide desired characteristics and aesthetics. The handle portion 2 and neck member 3 may be made of or with the same or different materials as the eyelid contact member 4. The handle portion 2, neck member 3, and the eyelid contact member 4 may be any desirable materials with any aesthetically desired colors or designs. The guide 1 as a whole, or the handle portion 2, neck member 3 and the eyelid contact member 4 may be fully or partially coated in a desired material, such as silicone to facilitate durability, easy secure gripping, easy cleaning, or comfortable contact with the eyelid 12.

As to application, a user may select the desired guide 1 based on a desired shape and size eyelid contact member 4 and handle portion 2 extension angle. The guide 1 may be integrally formed or consist of the various elements, such as one or more eyelid contact members 4, a handle portion 2 and a neck member 3, selected separately and attached to form the desired guide 1. In an embodiment where the eyelid contact member 4 is angularly adjustable, the user may rotate the eyelid contact member 4 either clockwise or counterclockwise with respect to the handle portion 2 or neck member 3, as desired for application of eyeliner 15.

Figure 1B:
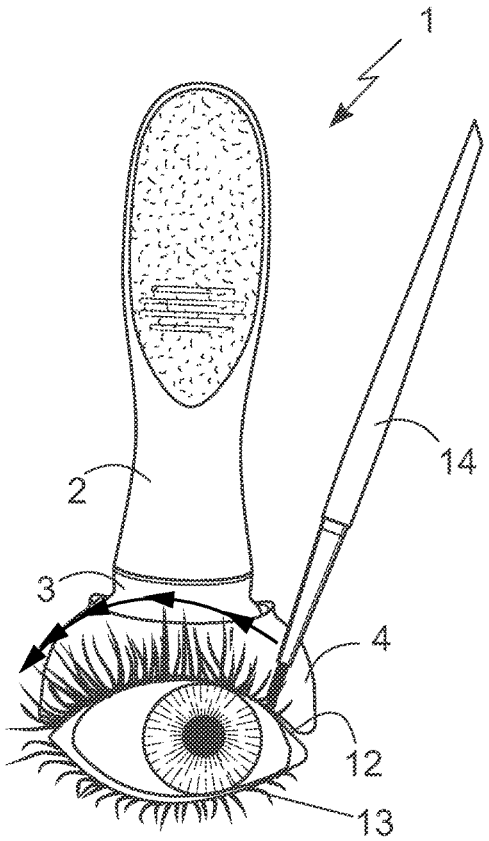
FIG. 1B is a front view of one embodiment of the eyeliner guide and eyeliner applicator positioned adjacent a user's upper eyelid prior to use and arrows showing the direction the eyeliner applicator may move during use.
Figure 2A:
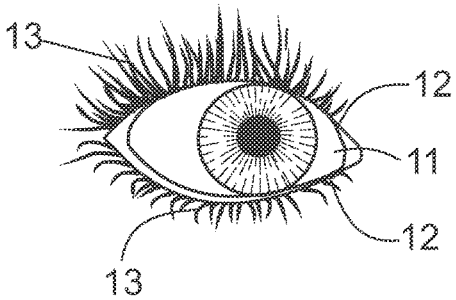
FIG. 2A is a front view of a user's eye area showing the eye, eyelid, and eyelashes before application of the eyeliner utilizing the guide.
Figure 2B:
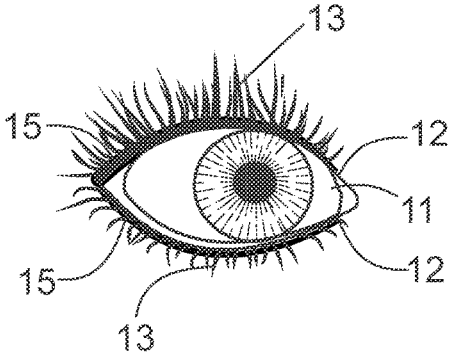
FIG. 2B is a front view of a user's eye area showing the eye, eyelid, and eyelashes after application of the eyeliner utilizing the guide.
Figure 3A:
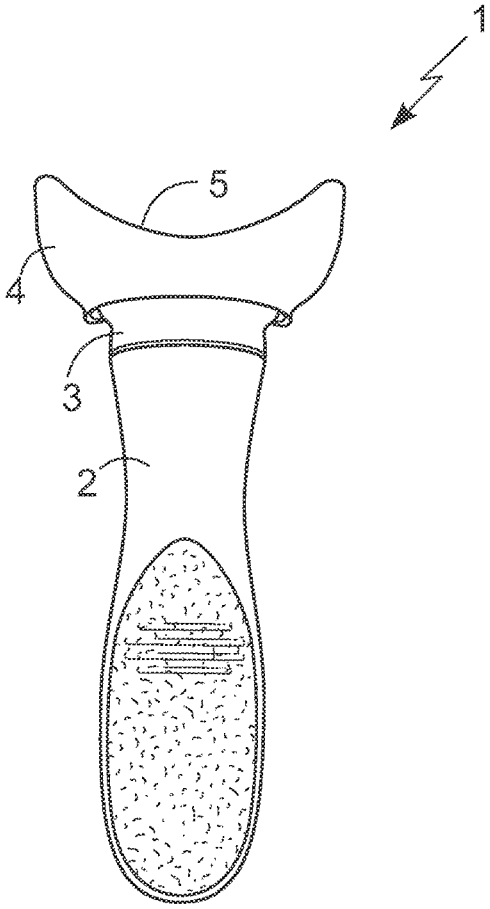
FIG. 3A is a front view of one embodiment of the eyeliner guide showing the handle, neck member, and eyelid contact member with its curved head attached.
Figure 3B:
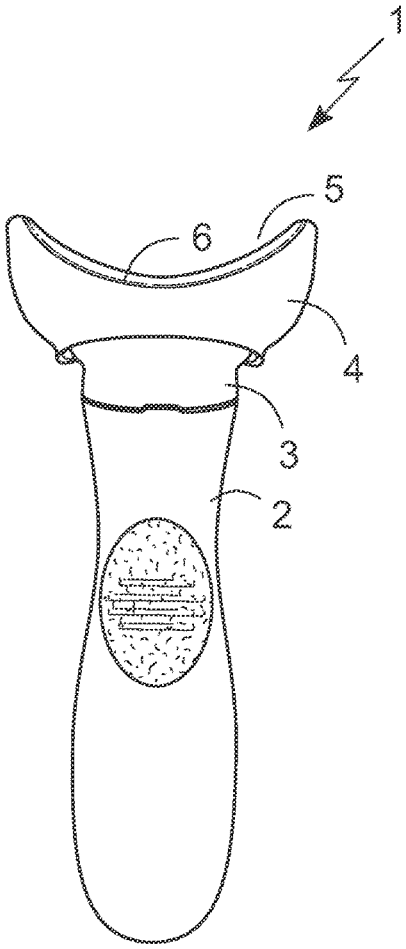
FIG. 3B is a rear view of one embodiment of the eyeliner guide showing the handle, neck member, and eyelid contact member with its curved head attached.

The user then applies the guide 1 to an eyelid 12 covering most of the eyelid 12 but leaving the desired amount of space between the curved head 5 of the eyelid contact member 4 and a user's eyelid 12 (or eyelashes 13) as shown in FIGS. 1A and 1B. An eyeliner applicator 14 may then be utilized in conjunction with the guide 1 to apply eyeliner 15 to the desired area, so that the user is simply tracing along the curved head 5 of the eyelid contact member 4 in order to achieve a straight, clean line along the user's eyelid 12, as shown in FIG. 2B. Once applied on a particular eyelid 12 of a particular eye 11, the process may be repeated by holding the guide 1, with or without adjustment of the angle of the eyelid contact member 4 with respect to the neck portion 3, to another eyelid 12 and utilizing an eyeliner applicator 14. As in FIGS. 1A and 1B, the process may be utilized for both top and bottom eyelids 12 on each eye 11.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An eyeliner guide comprising:

a handle portion having a top portion and a bottom portion, said top portion defining a neck member attached to one end of said handle portion, and said bottom portion including a contoured grip member with a rounded base;

a first eyelid contact member, comprising a hollow interior and a generally smooth arcuate rim forming a cushion portion on an outer face of the eyelid contact member so that the cushion portion comes into contact with a user's eyelid during use; the first eyelid contact member having a first end and a second end, said arcuate rim being shaped to accommodate the form of a user's eyelid, and said arcuate rim being removably attached to said neck member at a point about halfway between said first end and said second end and wherein the hollow interior fully surrounds the neck member when attached thereto;

wherein the attachment of said neck member and said first eyelid contact member lies in a plane disposed through a generally central portion of said rim and said first eyelid contact member; and wherein said first eyelid contact member is angularly adjustable with respect to said neck member via a series of mating détentes and recesses on one of said neck member and said first eyelid contact member, so that said first eyelid contact member may be rotated in either a clockwise or counterclockwise fashion and secured at a desired angle in a generally transverse direction with respect to said handle portion.

2. The eyeliner guide set forth in claim 1, further comprising a second eyelid contact member that may be interchangeably used with said first eyelid contact member, wherein said second eyelid contact member has a different curvature than said first eyelid contact member.

3. The eyeliner guide set forth in claim 1, wherein said handle portion defines a hollow portion therein.

4. The eyeliner guide set forth in claim 3, wherein said hollow portion in said handle portion is accessible for storage purposes.

5. A method of applying eyeliner comprising:

providing an eyeliner guide according to claim 1;

applying said eyeliner guide to an eyelid; and applying said eyeliner by drawing an eyeliner applicator along the desired portion of said eyelid adjacent a rim of the removably attached first eyelid contact member of said eyeliner guide.

6. The method of applying eyeliner set forth in claim 5, further comprising interchanging said first eyelid contact member with a second eyelid contact member that has a different curvature than said first eyelid contact member.

7. The method of applying eyeliner set forth in claim 5, further comprising providing a hollow portion inside a handle of said first eyelid contact member to store desired items therein.

8. The method of applying eyeliner set forth in claim 5, further comprising adjusting said first eyelid contact member angularly clockwise or counterclockwise with respect to a neck member of said eyeliner guide and securing said first eyelid contact member at a desired angle.

9. The method of applying eyeliner set forth in claim 5, further comprising providing a cushion portion on the outer face of said first eyelid contact member so said cushion portion contacts said eyelid during application of said eyeliner.

10. The method of applying eyeliner set forth in claim 5, further comprising providing a grip member on a handle of said first eyelid contact member to aid the user in gripping said eyeliner guide.

* * * * *